US006412807B1

(12) United States Patent
Arduin et al.

(10) Patent No.: US 6,412,807 B1
(45) Date of Patent: Jul. 2, 2002

(54) GLIDING APPARATUS WITH A BINDING INTERFACE DEVICE CONNECTED TO A SKI

(75) Inventors: Joël Arduin, Metz-Tessy; Axel Phelipon, Duingt; Christian Huyghe, Gruffy; Pierre Szafranski, Metz-Tessy, all of (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/438,412

(22) Filed: Nov. 12, 1999

(30) Foreign Application Priority Data

Nov. 13, 1998 (FR) ..... 98 14601

(51) Int. Cl.[7] ..... A63C 5/14
(52) U.S. Cl. ..... 280/607; 280/601; 280/610
(58) Field of Search ..... 280/607, 601, 280/602, 617, 618, 610, 609, 11.14, 636, 611

(56) References Cited

U.S. PATENT DOCUMENTS

| | | | | |
|---|---|---|---|---|
| 4,627,636 A | * | 12/1986 | Payraud | 280/607 |
| 5,046,751 A | * | 9/1991 | Scherubl | 280/607 |
| 5,143,395 A | * | 9/1992 | Mayr | 280/602 |
| 5,366,234 A | * | 11/1994 | Rohrmoser | 280/607 |
| 5,385,364 A | | 1/1995 | Nussbaumer | |
| 5,393,086 A | | 2/1995 | Le Masson et al. | |
| 5,397,149 A | * | 3/1995 | Couderc et al. | 280/602 |
| 5,397,150 A | * | 3/1995 | Commier et al. | 280/607 |
| 5,513,872 A | * | 5/1996 | Arduin et al. | 280/602 |
| 5,647,605 A | * | 7/1997 | Arduin | 280/602 |
| 5,746,439 A | * | 5/1998 | Boehim et al. | 280/602 |
| 5,758,894 A | * | 6/1998 | Maggiolo | 280/602 |
| 5,806,874 A | * | 9/1998 | Sedlmair | 280/602 |
| 5,895,067 A | * | 4/1999 | Stephanova et al. | 280/609 |
| 6,193,262 B1 | * | 2/2001 | Silva | 280/607 |
| 6,227,558 B1 | | 5/2001 | Arduin et al. | |

FOREIGN PATENT DOCUMENTS

| | | |
|---|---|---|
| EP | 0577947 | 1/1994 |
| FR | 2663234 | 12/1991 |
| WO | WO96/35488 | 11/1996 |

* cited by examiner

*Primary Examiner*—Lanna Mai
*Assistant Examiner*—Hau Phan
(74) *Attorney, Agent, or Firm*—Greenblum & Bernstein, P.L.C.

(57) ABSTRACT

A gliding apparatus having a binding interface device connected to a ski, the ski including a front plate having a mounting zone provided for a front retaining element, a rear plate with a mounting zone provided for a rear retaining element, a connection between the two front and rear plates, each plate being extended along the length of each side edge of the ski by a lower wing, and there being a journal element for binding the wings to the ski, wherein the ski has, at least along a portion of its width, a localized increase in thickness in two longitudinally spaced zones for binding the interface device and corresponding to the affixing of the journal elements.

22 Claims, 10 Drawing Sheets

8
15
19
31
28
V
V
10
32
2
30
14
1
6
4

23
46
49b
19
9
8
24
47
20
49a
15

Fig: 7
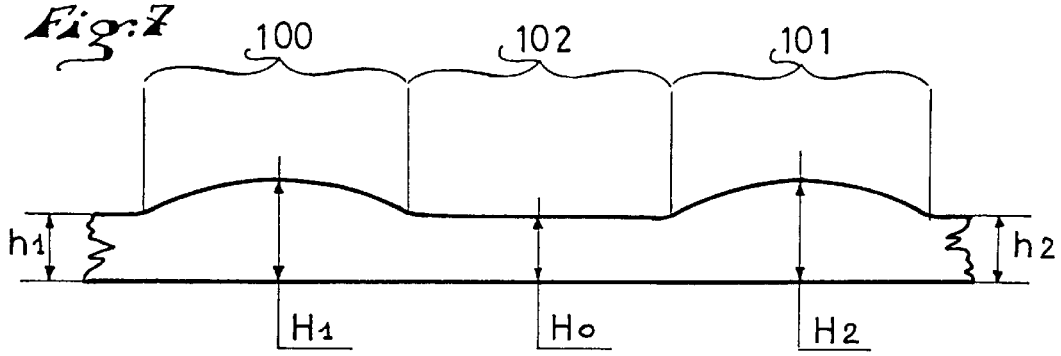
Fig: 8
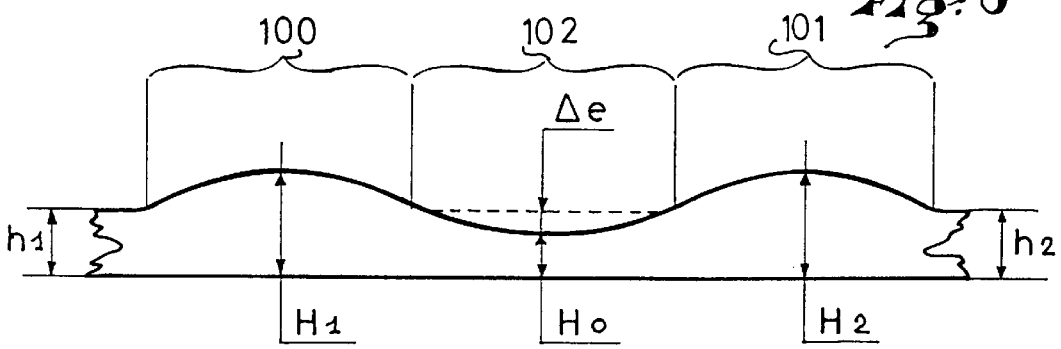
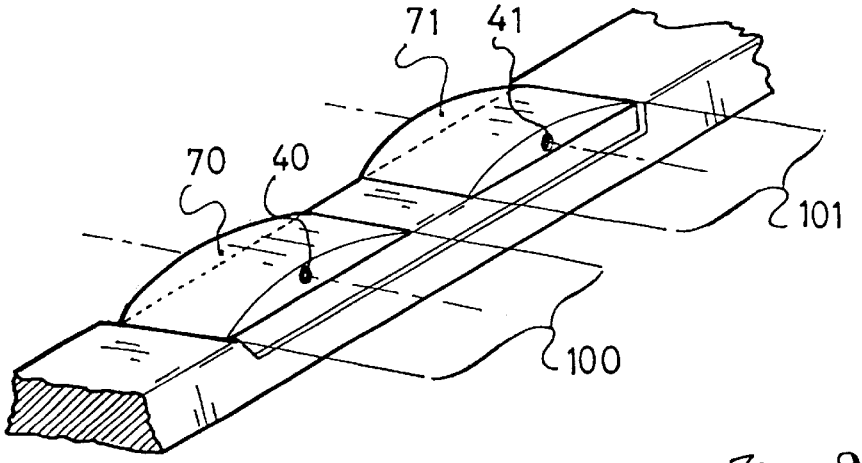
Fig: 9

Fig: 12
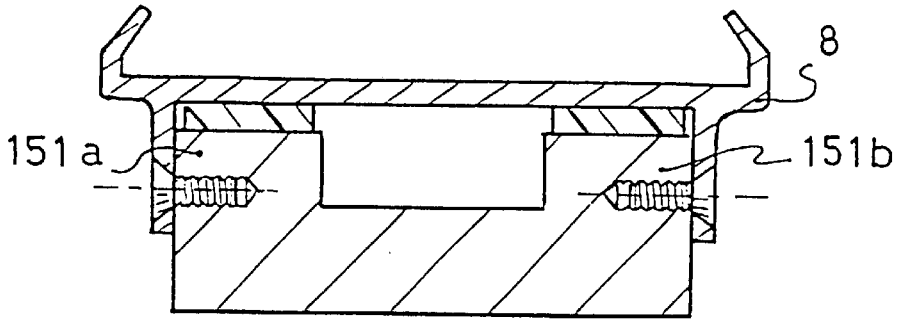
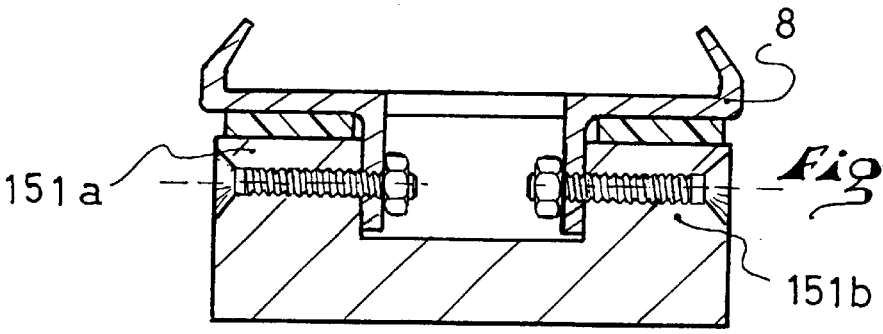
Fig: 12a
Fig: 13
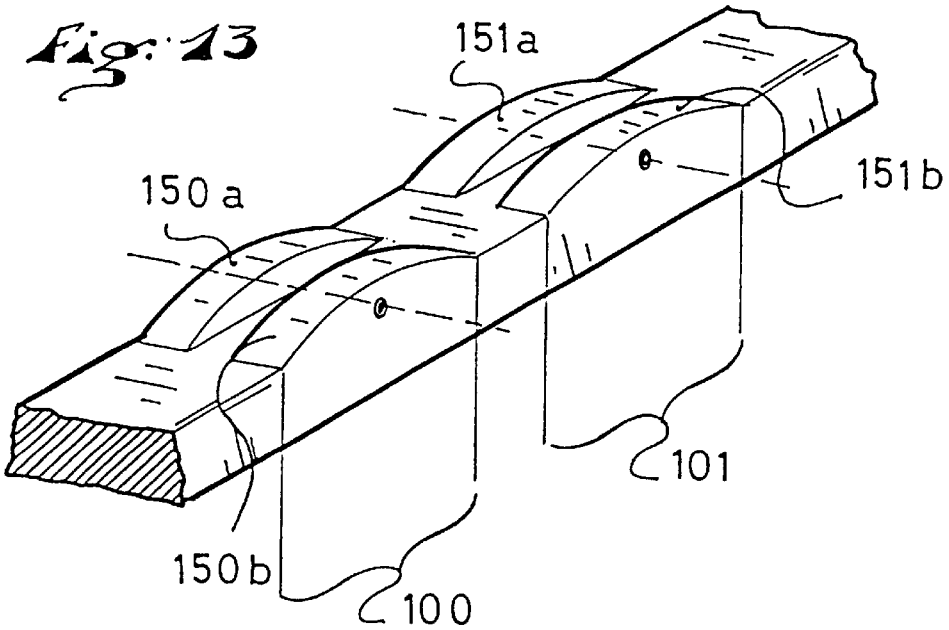

GLIDING APPARATUS WITH A BINDING INTERFACE DEVICE CONNECTED TO A SKI

BACKGROUND OF THE INVENTION

1. Field of the Invention

The invention is related to a gliding apparatus for alpine skiing, the apparatus including a binding interface device and a ski that is specifically adapted to receive such a device. The invention is also related to a ski considered independently of the device.

According to the invention, the gliding apparatus and the ski are adapted to a receive one of the skier's feet and, therefore, they are intended to be used in pairs.

2. Description of Background and Relevant Information

According to the Patent Application published as WO 96/35488, an interface device having an elongated plate on which the two retaining elements are mounted, is known. The plate is raised with respect to the ski. It is connected to the central portion of the ski by two pins whose spacing can be adjusted. Furthermore, a shock absorption element is interposed between each of the ends of the plate and the ski.

Such a device produces a greater concentration of pressure in the central zone of the ski. In addition, in view of the fact that the two retaining elements are mounted on a single plate, separate from the beam of the ski, the ski is freed from the stresses generated by the boot retaining elements.

This interface device provides satisfactory results; indeed, it allows the ski to bend naturally, and while executing turns, the ski follows its path in a natural curve, especially in case of skis having heavily cambered side cuts. But at high speeds, it causes the ski to float somewhat because the plate is only retained on the ski along a short length. Additionally, the ski is free along a greater length towards the front and rear, as compared to a traditional ski, precisely because of the plate connection method. As a result, the ski is more sensitive to vibrations caused by the relief of the terrain, and the plate acts like an insulating element between the boot and the ski.

French Patent Application No. 98/02868 proposes a solution to improve the conditions in which the boot steers the ski, especially aiming to provide a smoother steering of the ski in alternating wide and tight turns. Thus, the application is related to an interface device equipped with a plate, with a front portion being a mounting zone provided for a front retaining element, a rear portion with a mounting zone provided for a rear retaining element, a non-extensible connection being present between the two front and rear portions. On each side of each portion it has a lower wing which is set back with respect to the end of the plate portion, the wing being provided to be pressed against a side wall of the ski, and each wing having a single journal element for affixing the wings to the ski.

One drawback of this type of device is due to the fact that it is attached to the sides of the ski. Indeed, the ski has its own distribution of thickness which depends on the stiffness that it must impart. The insertion of journal elements having substantial diameters has the effect of making the ski structure fragile in certain areas in which the thickness is relatively small.

Another drawback is due to the fact that the supports are transmitted from the plate along the ski through a very specific connection zone, thereby resulting in the inadequate distribution of substantial stresses along the ski surface.

It has also been recognized that the results of the device could be improved by adapting the characteristics of the ski to the device; in particular, by controlling its thickness distribution, and therefore its stiffness, so that the device becomes more efficient.

SUMMARY OF THE INVENTION

It is an object of the invention to provide a ski for alpine skiing, the ski having a central zone provided to receive the boot retaining elements. In the central zone of the ski, the ski has two longitudinally spaced zones of increased thickness in which the top surface of the ski has a convex shape due to the progressive variation in its thickness, consisting of an undulation in which the ski thickness increases and then decreases progressively.

Another object of the invention is to provide a gliding apparatus consisting of a binding interface device connected to a ski, the device including:

a front plate having a mounting zone provided for a front retaining element, a rear plate with a mounting zone provided for a rear retaining element, each plate being extended along each side edge of the ski by a lower wing, and for each wing there being a journal element for affixing the wings to the ski.

The ski of the gliding apparatus has, along at least a portion of its width, a localized increase in thickness in two longitudinally spaced zones of the binding interface device that corresponds to the affixing of the journal elements.

BRIEF DESCRIPTION OF THE DRAWINGS

Other characteristics of the invention will become apparent from the drawings and the detailed description attached hereto, but these should not be considered as representing restrictive examples.

FIG. 7 is a schematic side profile view of the ski according to a first possible embodiment of the invention;

FIG. 8 is a view similar to FIG. 7 according to a second possible embodiment of the invention;

FIG. 9 shows a perspective view of the central portion of a ski according to an embodiment variation of the invention;

FIG. 12 is a transverse cross-sectional view similar to the cross-section of FIG. 10 but according to yet another embodiment of the invention;

FIG. 12*a* is a view that is similar to FIG. 12 according to an embodiment variation;

FIG. 13 is a perspective view of a portion of the ski without the device, in the context of FIG. 12;

DETAILED DESCRIPTION OF THE INVENTION

Figure 1:
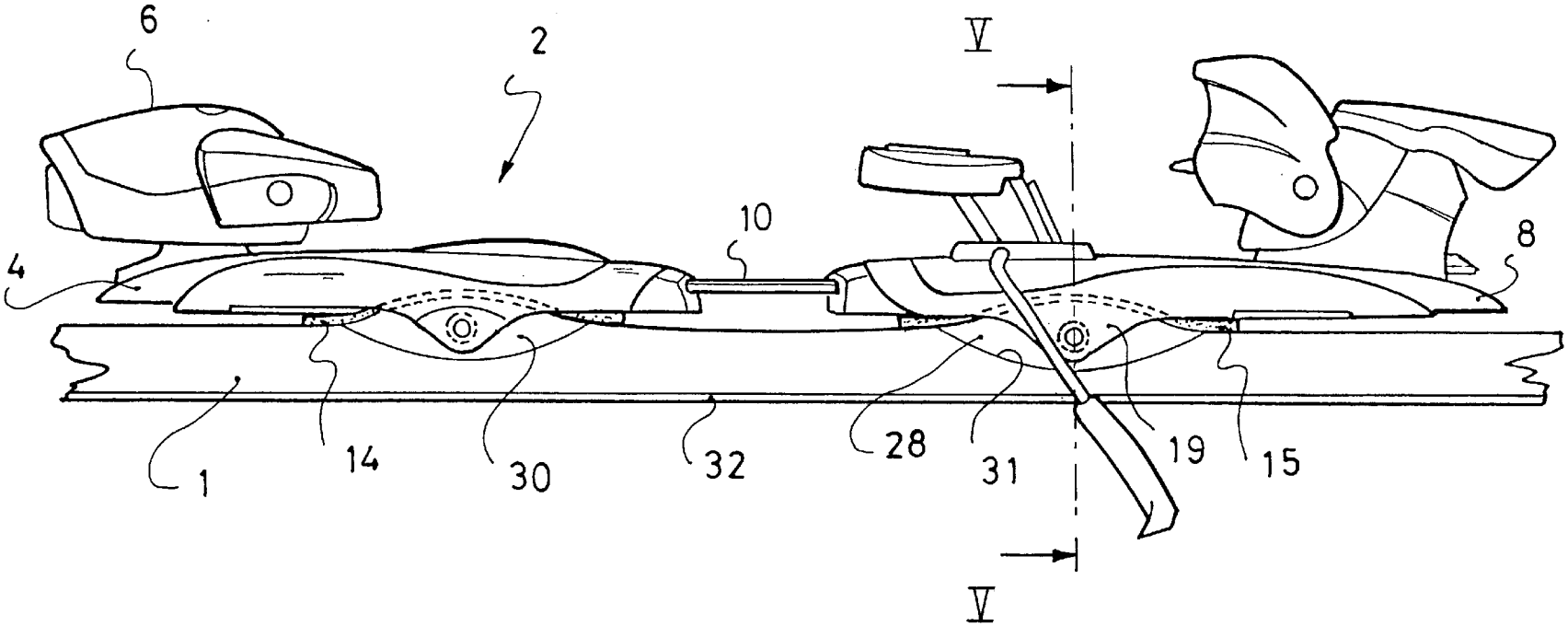
FIG. 1 represents a side view of one embodiment of the central portion of the gliding apparatus equipped with the device according to the invention.

FIG. 1 represents the median portion of a ski 1 overhung with an interface device 2 obtained according to a first embodiment of the invention.

The interface device 2 extends above the ski, along the longitudinal direction defined by the ski. The length of the device is provided to support the boot and the two boot retaining elements on the ski.

Figure 2:
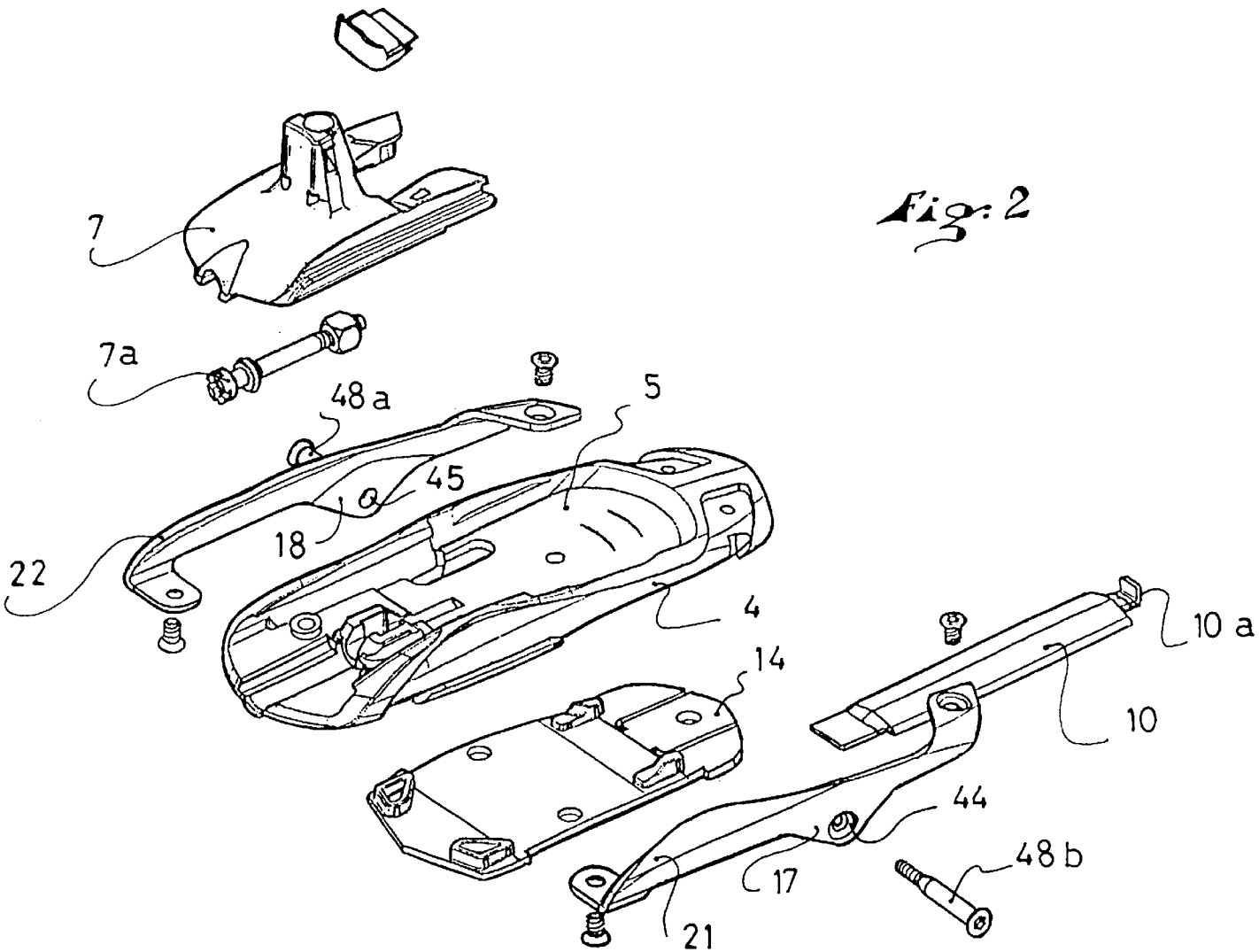
FIG. 2 is an exploded view of the elements forming the front portion of the apparatus of FIG. 1.

The device 2 has a rigid front plate 4 which has, on its upper surface, a mounting zone 5 adapted for a front retaining element 6. This element is provided to retain the front tip of a boot, and is of a known type and has not been described in detail herein. Advantageously, as shown in FIG. 2, the mounting zone 5 is shaped like a slide in which the base 7 of the front retaining element is guided. The longitudinal position of the base is adjusted by a screw 7*a*. Other means allowing for the adjustment of the longitudinal position of the front element can be used, for example, a series of holes provided for screws assembling the base to the plate 4. Other constructional methods can also suffice, for example, the base can be made all in one piece with the plate.

Furthermore, the interface device has a rigid rear plate 8, with a mounting zone 9 provided for a rear retaining element. This element is also of a known type and has not been described in detail herein.

Both plates are made from any appropriate material, for example, from a plastic material, whether fiber reinforced or not.

In the embodiment illustrated, the two plates 4 and 8 are joined by a non-extensible connection 10. The connection 10 resists any relative distancing of the plates, but it is neutral should the plates approach one another, i.e., it provides no resistance. As represented in the drawings, the connection 10 is a shaped metallic plate whose front portion is affixedly connected to the front plate, for example, by a screw. The rear portion of the joining plate has a bend 10*a* that is housed, with some allowance, in a housing 11 located beneath the rear plate 8. The connection 10 resists the spacing of the plates by taking support against the front wall of the housing 11. In case the plates approach one another, the bend 10*a* becomes displaced freely in the housing 11. Another housing 12 and other housings can be provided to adapt the spacing of the plates to the length of the boot. Other connections can also suffice, for example, a flexible band, or a cable. It could also be possible not to have a connection between the plates.

Both plates are kept raised above the ski. In the first instance, each of the front and rear plates rests on an elastic pad, respectively 14 and 15. These could be, for example, pads made from an elastomer material. They are preferably located in the zone of the support plates of the retaining elements, i.e., respectively at the front and at the rear of the front and rear plates. In addition to the raising of the plates, they create a filtering effect between the plates and the ski.

Furthermore, each of the plates is borne by the lateral wings that are provided to descend along the ski edges. The wings are set back with respect to the ends of the front and rear plates, i.e., along a longitudinal direction, their overall space requirement is less than the space requirement of each of the plates. In this manner, the wings concentrate the stresses transiting between the interface device and the ski along the median portion of the central zone of the ski.

Thus, with reference to the drawings, the front plate 4 is borne by two lateral wings 17 and 18, and similarly, the rear plate 8 is borne by the wings 19 and 20. Preferably, along a longitudinal direction, the wings are located at the height of the front and rear support plates of the boot retaining elements, i.e., in the front and rear zones respectively of the front and rear plates.

Figure 3:
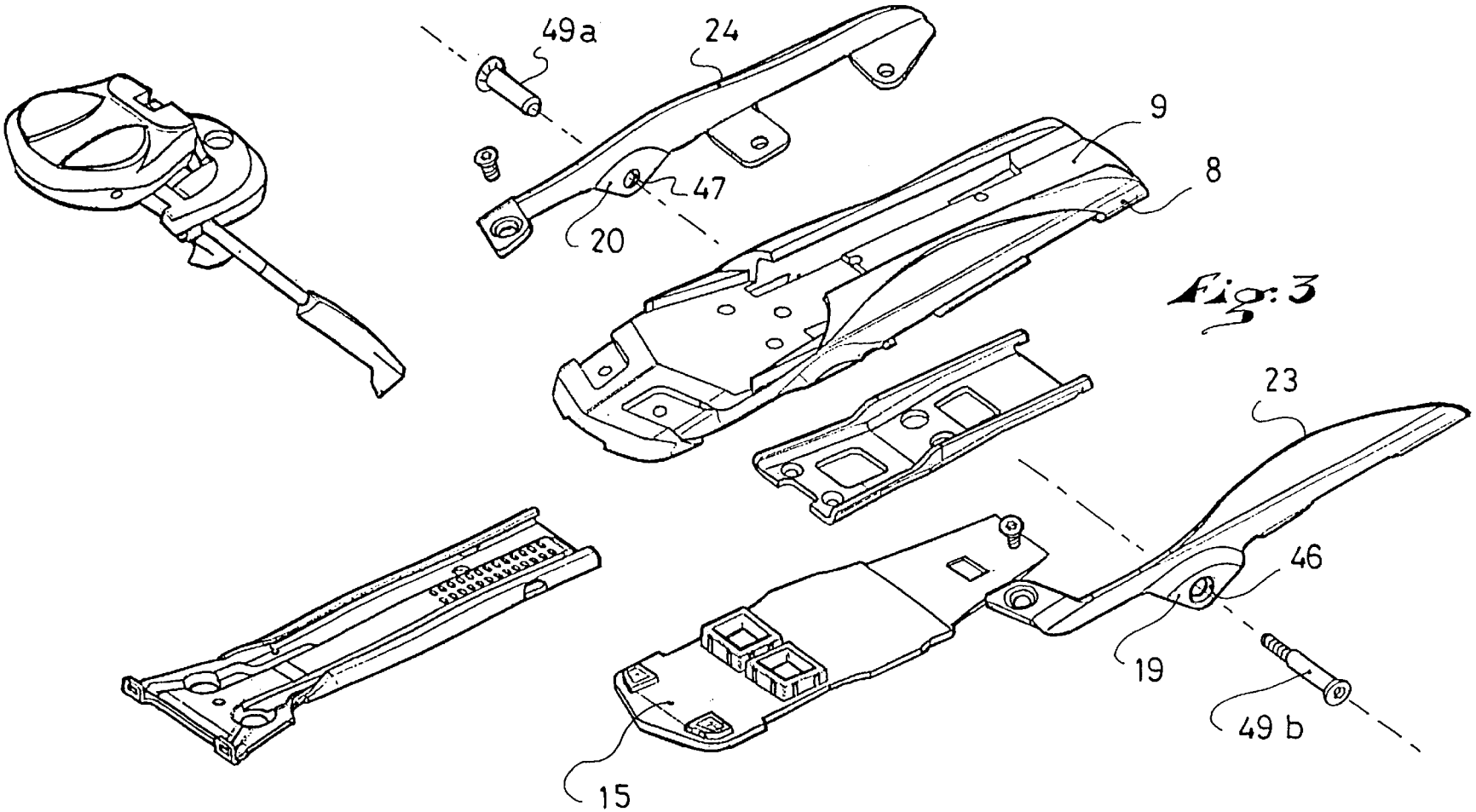
FIG. 3 is an exploded view of the elements forming the rear portion of the apparatus of FIG. 1.
Figure 4:
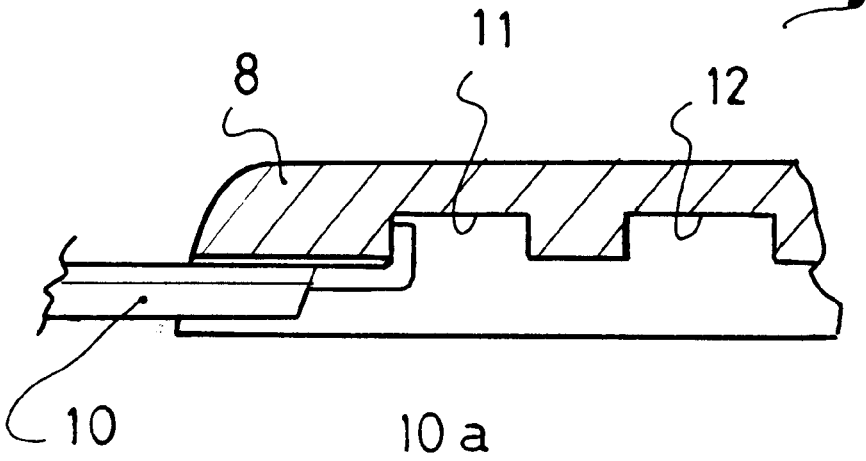
FIG. 4 illustrates a constructional detail of the gliding apparatus.

According to the drawings, the wings are the lower support elements 21, 22, 23, 24 that are affixedly attached in pairs to the front and rear plates 4 and 8. The supports can be obtained from any appropriate material, especially metal, aluminum alloy or other, or from a plastic material, whether fiber reinforced or otherwise. Any appropriate means could suffice to affix the supports to the plates, for example, as can be seen from FIGS. 2 and 3, the supports have tabs that are engaged above and below the plates, with openings provided for the binding screws. Other affixing means between the supports and the plates can also suffice, for example, the supports could be assembled by gluing or welding to the plates.

This method of construction is not restrictive either, and the wings could also be made all in one piece with the front and rear plates.

Like the pads, preferably, the wings extend towards the rear portion of the front plate and along the front portion of the rear plate, so as to realign the connection zone between the interface device and the ski, and so as to leave the two ends of the interface device raised and without any rigid retaining connection with the ski.

Figure 5:
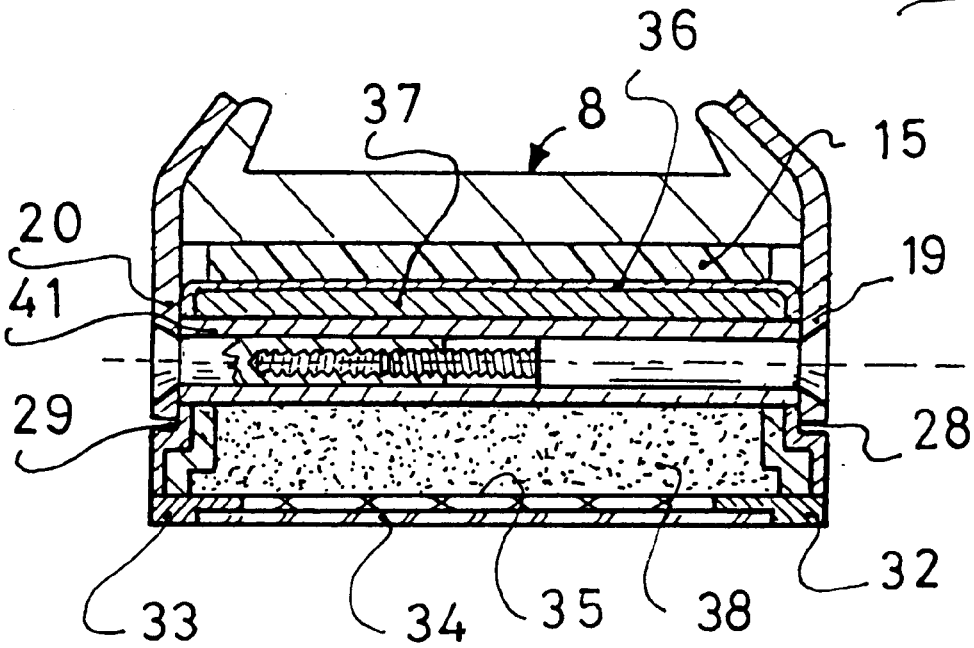
FIG. 5 is a cross-sectional view along line V—V of FIG. 1.

FIG. 5 is a cross-sectional view of the assembly of the rear supports to the ski. The ski has, in a known manner, a gliding sole 34 with a lower internal reinforcement layer 35 between the two bottom running edges 32 and 33 above the gliding sole. At the top, the ski has an outer shell 36 that descends laterally up to the running edges, and an upper internal reinforcement 37 located under the shell, that also descends to the running edges. Between the lower and upper reinforcement layers 35 and 37 within the structure of the ski, the ski structure has a core 38, which is of any appropriate type. Other ski structures could also suffice. In particular, there could be several lower and/or upper reinforcement layers.

Figure 6:
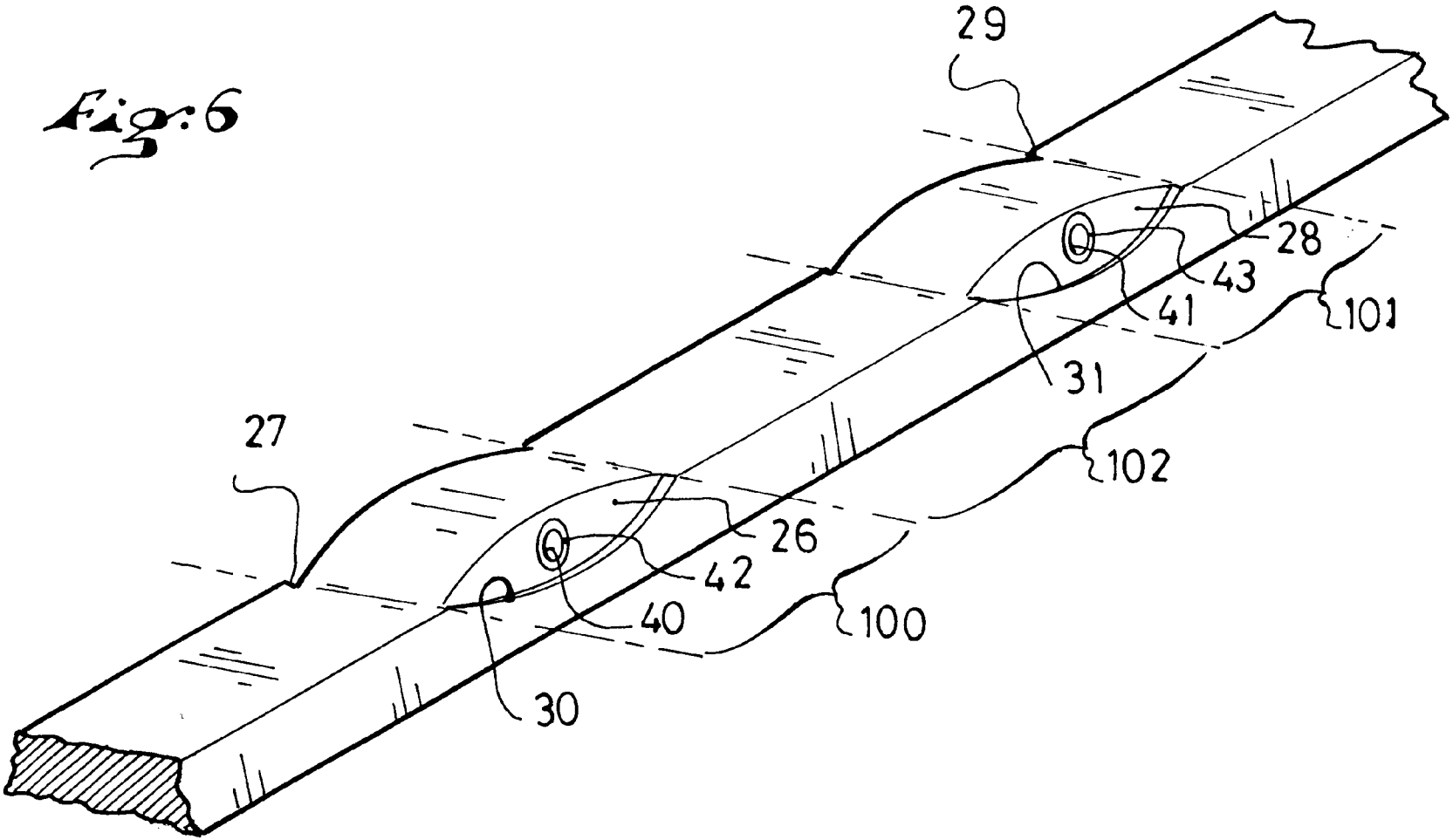
FIG. 6 shows a perspective view of the central portion of the ski of FIG. 1.

Based upon the showing in FIG. 5, considered together with FIGS. 1 and 6, for example, it can be seen that the ski includes a plurality of structural components, i.e., at least a core 38, a gliding sole 34 beneath the core, and an upper reinforcement layer 37 above the core. These structural components extend through the boot retention portion of the ski for supporting front and rear boot retaining elements. As seen in FIG. 6 and as described below, the boot retention portion of the ski has a variable thickness between the upper and lower surfaces of the ski, i.e., including at least the two longitudinally spaced apart zones 100 and 101, each of said spaced apart zones having an increased thickness relative to thicknesses of longitudinally adjacent zones, i.e., the intermediate zone 102 and a zones forward of front zone 100 and rearward of rear zone 101. Further, the upper reinforcement layer 37 is more greatly spaced from the gliding sole 34 in the two longitudinally spaced apart zones 100, 101 than in the longitudinally adjacent zones.

The wings are provided to descend along the side edges of the ski. For example, as can be seen in FIGS. 1, 5, and 6, towards the middle of its central portion, the ski has cut-outs 26, 27, 28, 29 provided for each of the wings. The cut-outs are provided to receive the wings 17, 18, 19, 20. One could also have two cut-outs, one on each side of the ski to receive the two wings of the front and rear plates.

In the area of the running edges, the cut-outs create a shoulder just above the running edge. Only the shoulders 30, 31 are visible in the drawings. Preferably, the wings do not take support against this shoulder and stop slightly above it so as to avoid a direct contact with the running edges.

The wings are provided to be pressed against the side walls of the ski formed by the base of the cut-outs. This type of construction enables avoiding projecting elements along the side edges of the ski, which would adversely affect gliding along the side edge and the turn execution characteristics of the ski.

The wings and these walls are substantially vertical, i.e., perpendicular to the gliding surface of the ski. This is not restrictive, and these surfaces could also be slightly inclined in a converging manner towards the top of the ski, so as to have a conical fitting effect in the connection between the wings and the walls of the ski.

According to the invention, the wings are connected to the ski structure by journalled binding elements. In other words, instead of having a fixed connection of the interface device or the supports to the ski, the connection between the interface device and the ski is provided here by a journal that connects each wing to the ski structure. This journal allows a relative rotation between the ski and the supports about the transverse connecting axis defined by it. The filtering pads do not resist this relative rotation; on the contrary, they add to the freedom of the ski. The cut-outs 26, 27, 28 and 29 and their shoulders are also provided to allow such a movement.

FIG. 5 shows the two lateral cut-outs 28 and 29 in which the wings of the two rear supports 19 and 20 are housed; it also shows the filtering pad 15, and the rear plate 8.

A crossing insert 41 passes through the ski structure from one side to the other, ending on each side wall of the ski in the area of the lateral surfaces of the cut-outs 28 and 29. In this way, the insert passes through the two side edges of the upper reinforcement layer 37 forming an inverted U.

The crossing insert 41 is internally smooth.

A second crossing insert 40 of the same type as the insert 41 also passes through the ski in the area of the front supports. The inserts are made of any appropriate material, for example, of an aluminum alloy, steel or a plastic material. In order to assemble them in the ski, the ski is first bored with two openings 42, 43, then the crossing inserts 40, 41 are attached to these borings 42, 43. These inserts can also be placed in the mold when the ski is being manufactured.

Each of the wings has an opening 44, 45, 46, 47 across from the insert openings.

The journal that connects each of the plates to the ski is constituted of a screw 48*b,* 49*b* screwed into a socket screw 48*a,* 49*a,* i.e., a screw with an internally threaded socket, the assemblies 48*a,* 48*b* and 49*a,* 49*b* extend through the wings of the supports and are engaged in the inserts 40, 41.

Preferably, the openings 44 through 47 are countersunk at their openings, and the screws 48*a,* 48*b,* 49*a,* 49*b* have countersunk heads. The vertical position of the openings 44 through 47 is also provided to be such that the axis of the openings is slightly raised with respect to the axis of the inserts when the interface device and the supports are simply placed on the ski with the intermediate pads. In this way, by being positioned in their housings, the countersunk heads of the screws 48*a,* 48*b,* 49*a,* 49*b* force the supports downwards, which produces a slight compressive stress and a pinching of the pads 14 and 15. This promotes a good connection between the retaining elements and the ski for the transmission of the lateral supports. Any other appropriate means to establish this pinching could also suffice. In addition, the pre-stress is preferred, but it is not obligatory.

Each insert with its two binding screws defines a connecting axis of the interface device to the ski. The screws are journalled assembly elements insofar as they allow a relative rotation of the wings and the ski about the connecting axis.

Good results were obtained during experiments with a construction of the type described in FIGS. 1 through 6, by using crossing inserts having a diameter of 6 millimeters.

A ski such as illustrated is equipped with smooth inserts. One could also use an insert that is threaded at each of its ends, or even self-threading screws, by boring the ski at a diameter that is smaller than the diameter of the screw, as is the case in the traditional assembly of a retaining element in a ski.

The ski is adapted to receive these journal elements without any adverse effects on its structure. In order to achieve this, the ski has localized and progressive thickness variations in a front zone 100 of the ski, which corresponds to the affixing of the journal means of the front plate 4 and localized and progressive thickness variations in a rear zone 101, which corresponds to the affixing of the journal means of the rear plate 8.

These variations consist of an undulation where the thickness increases progressively and then decreases until it substantially attains its nominal thickness either forward of or rearward of the zone.

In the example of the embodiments of FIGS. 1 through 6, the increase in thickness relates to a portion constituting the entire width of the ski. Between the two zones of increased local thickness, there is an intermediate zone 102 where the ski has substantially the same thickness as it does beyond the zones 100 and 101.

The upper surface of the ski in the binding zones 100, 101 locally has a substantially convex shape extending in the longitudinal direction of the ski which corresponds to a progressive variation in thickness.

Thus, as can be seen in FIG. 6, in the zone 101, the thickness of the ski increases progressively until it peaks, then decreases progressively in the direction of the zone 102. In the zone 102, the thickness of the ski is substantially constant, and it is close to the thickness of the ski forward of and rearward of the zones 100 and 101. In the zone 101, the thickness of the ski increases and decreases in the same manner as in the zone 100. The thickness of the ski at the peak of the zone 100 can be different from that at the peak of the zone 101. If such is the case, it is preferably greater at the peak of the zone 101.

The thickness of the ski in the zone 102 can have progressive variations in thickness consisting of an undulation where the thickness of the ski decreases progressively to within the nominal thickness, forward of and rearward of the zones 100 and 101, then increases progressively. In such a case, the ski would be more flexible between the two zones 100 and 101.

This shape has the advantage of promoting the dispersion of the supports taken on the device in the direction of the ski.

Good results were obtained with the zones 100 and 101 extending longitudinally over a distance of 100 to 150 millimeters, and having an additional thickness of 4 to 6 millimeters at their peaks.

Preferably, the journal elements are located above the neutral plane and in support beneath the upper reinforcement element 37 of the ski. However, due to the shape of the ski, the position of the journal elements can be controlled depending on the degree of raising of the interface device with respect to the ski. In particular, for smaller sized skis in which the thicknesses are less, the anchoring of the journal elements would be better if it were further away towards the top of the neutral plane so as to avoid mounting problems for the interface device.

Good results were obtained with a journal element whose axis was located 6 to 7 millimeters below the peak of the zones 100, 101.

The interface device is raised with respect to the ski, it has no fixed connection with the upper surface of the ski, and it is connected to the ski in the zones of the increased thickness about two transverse connecting axes that pass through the ski structure towards its neutral plane. Along the longitudinal direction, the connecting axes are located in the area of the wings, i.e., at the height of the pads 14 and 15, and the support plates of the retaining elements. As a result, the ski is free along a greater length. It is also freed from the recovery torque of the bindings when the ski bends. Furthermore, because the connecting axes are located beneath the upper surface of the ski, they are close to the neutral plane and, as a result, the relative movements between the wings and the ski have a small amplitude.

As illustrated in FIG. 7, the minimum value $H_o$ of the intermediate zone is substantially equal to the values $h_1$, $h_2$ that externally border the convex binding zones 100, 101. Consequently, the ski becomes locally more resistant to bending in the zones 100 and 101.

According to a variation represented in FIG. 8, the reduction in thickness in the intermediate zone 102 reaches a minimal value $H_o$, less than the thickness values $h_1$, $h_2$ that externally border the convex binding zones 100, 101, which furthermore attain the maximum values $H_1$, $H_2$ in their median portion. The difference in thickness between $H_o$ and $H_1$, $H_2$ is defined by the dimension $\Delta e$. In this case, the bending properties of the ski in the middle of the ski, between the two boot supports, are promoted.

FIG. 9 shows a ski according to the invention which has independent elements 70, 71 attached on the ski body and fixed thereto by appropriate means, such as glue, vibration welding, screws, etc. Along with the ski body, these elements form increased thickness zones 100, 101. The journal elements 40, 41 preferably pass through these elements 70, 71. These elements can also form an integral part of the ski structure, while at the same time constituting inserts positioned under one or several surface or reinforcement layers of the ski.

Figure 10:
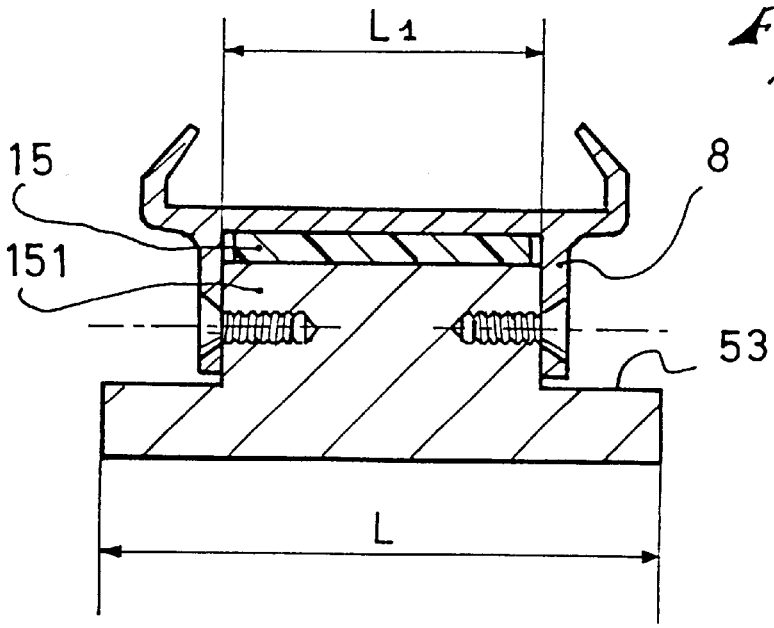
FIG. 10 is a simplified transverse cross-sectional view, similar to the cross-section of FIG. 5, but according to another embodiment.
Figure 11:
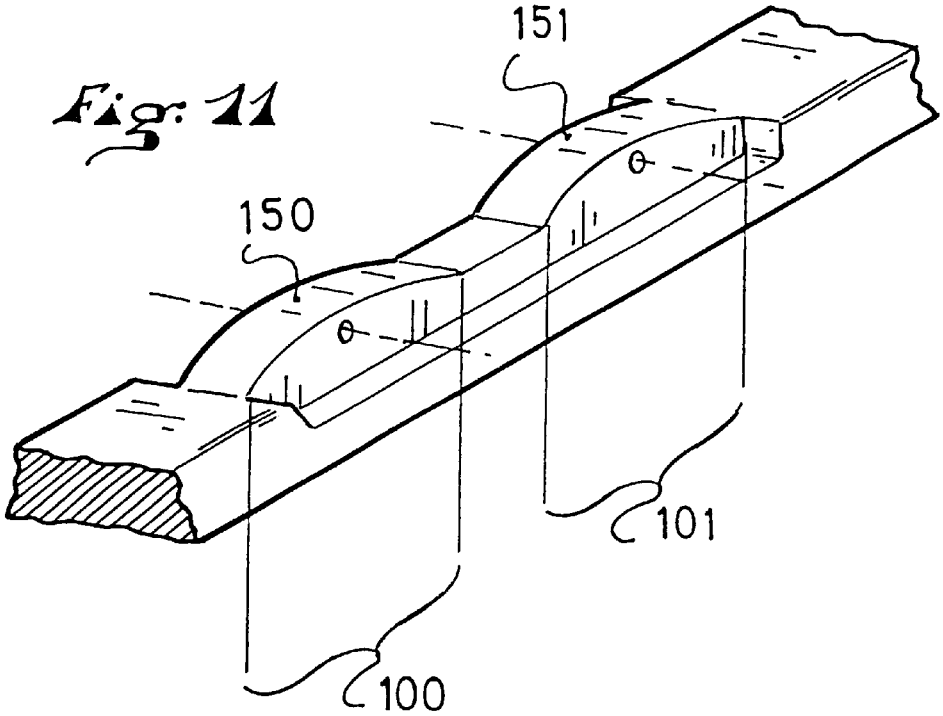
FIG. 11 is a perspective view of a portion of the ski without the device, in the context of the embodiment of FIG. 10.

FIGS. 10 and 11 show that the convex binding zones can extend along only a portion of the width $L_1$ of the width L of the ski so as to limit the lateral space requirement of the device, especially of the wings on the sides of the ski. Thus, each single longitudinally spaced central portion 150, 151 is bordered by lowered ski portions.

Conversely, FIGS. 12 and 13 show laterally separated front portions 150*a*, 150*b* and rear portions 151*a*, 151*b*, each of these receiving a journal element so as to be able to obtain a grip on the device.

According to FIG. 12*a*, the wings of the plate are pressed against the inner faces of the lateral portions 151*a*, 151*b*.

Figure 14:
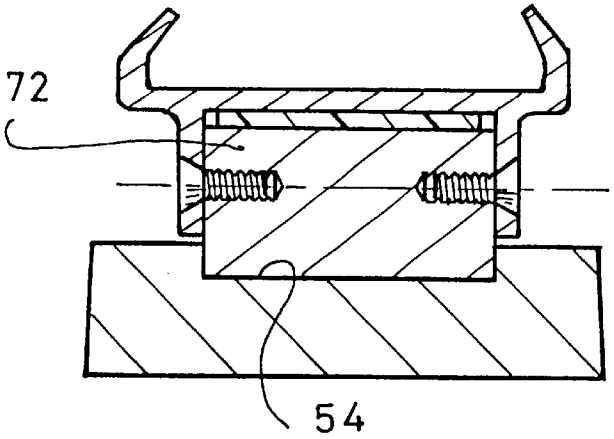
FIG. 14 is a cross-sectional view that is similar to that of FIG. 10 but according to an embodiment variation.

Finally, FIG. 14 shows an embodiment in which an independent element 72 is inserted in a central housing 54 having a complementary shape in the ski body. The element 72 can be affixed to the body by any appropriate means, such as by gluing, vibration welding, screwing, etc.

Figures 15, 16:
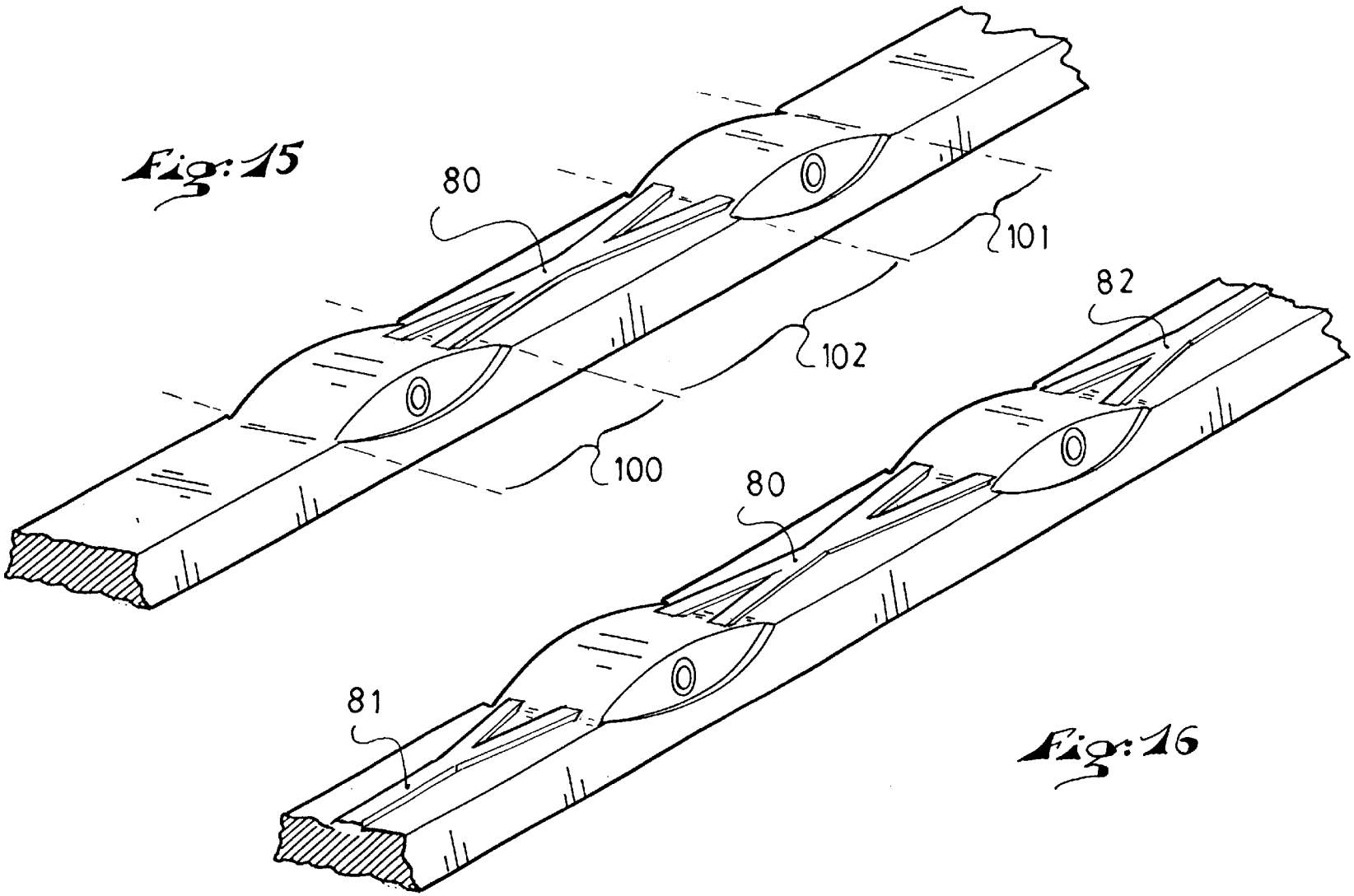
FIGS. 15 and 16 are related to embodiment variations of the ski of FIG. 1.

FIG. 15 represents an embodiment variation of the ski of FIG. 1. According to this variation, the ski has a reinforcement 80 in its intermediate zone 101. Here, the reinforcement is shaped like a cross, the ends of whose arms disappear in the bosses of the zones 100 and 101. For example, it is formed by reinforcement strips made of fiber reinforced resin, aluminum strips, or any others, that are located on the upper reinforcement and that are affixed to such upper reinforcement. This reinforcement lessens the local decrease in the spring constant and the torsional spring constant that the ski exhibits between the zones 100 and 101 of increased thickness. In these zones 100 and 101, precisely because of the increase in thickness, the spring constant and the torsional spring constant of the ski is increased in a localized manner. The reinforcement 80 prevents, or at least reduces, bending or flexion of the ski between these two zones.

According to the variation of FIG. 16, the ski has this same X-shaped reinforcement between the zones 100 and 101. In addition, in front of and behind these zones, the ski has two reinforcements 81 and 82 which, in the embodiment illustrated, have a Y shape. These reinforcements are of the same type as the reinforcement 82. They reinforce the spring constant and the torsional spring constant of the ski forward and rearward of the zones 100 and 101, and thus disperse the local stiffness curve of the ski upstream and downstream of the ski. As indicated previously, the stiffness of the ski is increased in the zones 100 and 101. The reinforcements 80, 81, 82 ensure a progressive variation in the local stiffness, or rigidity, of the ski.

In a variation, it would be possible to have just one of the two reinforcements 81, 82.

The invention is also related to a ski considered independently of the device insofar as such a ski, while certainly particularly well adapted to receiving the device, can however, also be used with other devices or with traditional binding elements, while providing certain benefits as compared to traditional skis. Specifically, it was noted that such a ski experienced less camber loss during cooling after the molding operation, due to its special geometry.

Figure 17:
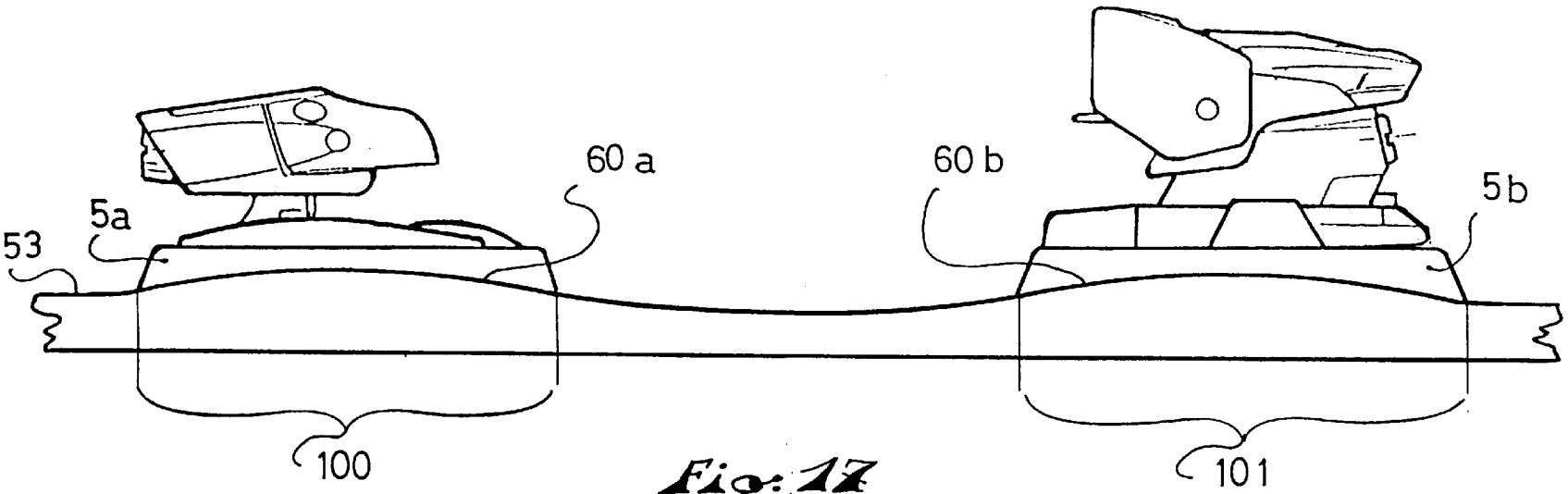
FIG. 17 represents a profile view of a ski/binding assembly according to another preferred embodiment of the invention.

Thus, as shown in FIG. 17, the ski is overhung with an interface device in the form of a front plate 5*a* to receive a front binding element, and a rear plate 5*b* to receive a rear binding element. The plates 5*a*, 5*b* are independent of one another in the sense that they are not attached by a non-extensible connection.

The ski has, under the arrangement of each plate, a localized increase in the height of its upper surface in the two longitudinally spaced zones 100, 101; the plates have a bottom surface shape 60*a*, 60*b* that is adapted and complementary to the shape of the top surface 53 of the ski in the zones considered.

Thus, the plates 5*a*, 5*b* play an essential role in allowing the adaptation of the binding elements to the areas of overthicknesses 101, 101. The plates are attached and affixed to the ski, preferably by inserting screws through the plates up to the reinforcement structure of the ski. The plates provide a stable support on the ski for the boot binding elements.

As was the case in the previous embodiments, in each zone 100, 101 covered by the plates 5*a*, 5*b*, the top surface 53 of the ski locally exhibits a substantially convex shape extending in the longitudinal direction of the ski, and corresponding to a progressive variation in height. This special shape similarly provides a better dispersion of the supports taken by the skier on the ski in the two plate anchoring zones; this with respect to a traditional mounting of the binding elements on a ski having a traditional geometry.

The plates 5*a,* 5*b* can also be connected by a non-extensible connection or be constituted of one single piece.

In the terminology used in the description, the term "thickness" of the ski generally denotes the distance between the bottom surface of the ski and the top surface of the ski, at a given longitudinal position, without the interface device. This distance is measured, however, by including the elements attached in or on the basic body of the ski; these are used to locally increase the distance in the context of the invention. The term "height" is used in reference to the top surface of the ski as compared to the gliding surface.

The term "width" of the ski denotes the distance separating the side edges of the ski as measured along the plane of the top surface of the ski.

Finally, the invention can find an application in any type of ski, including skis having wasp-waisted side cuts, wide skis, and short skis whose length is comprised between approximately 0.50 and 1.50 meters.

The instant invention has only been provided as an example, and other embodiments could be envisioned without leaving the scope of the invention.

In particular, it is not necessary that the connecting axes be exactly transverse, i.e., perpendicular to the longitudinal direction of the ski. The position of the two journals located on either side of the ski could be offset longitudinally so as to place the connecting axis at an oblique angle with respect to the longitudinal directional of the ski. This angular offsetting would be transferred, but in an inverse manner, on the other ski. This could create an elastic return effect from the front and rear portions of the ski when the ski bends, and promote the lateral deformation of the ski during edge setting. In this way, the curve setting of the ski in a turn could be promoted by concentrating the supports more to one side than the other side of the ski.

Other variations can also be adopted as regards the journal binding means. As indicated previously, their longitudinal position on the ski could be different from the positioned described, i.e., instead of being located towards one end of the front and rear plates, the wings could be located more towards the middle of the interface device.

In addition, the space between the interface device and the ski could be filled, especially towards the middle of the interface device, with a localized overthickness of the ski.

The instant application is based upon French Patent Application No. 98 14601, filed in Nov. 13, 1988, the disclosure of which is hereby incorporated by reference thereto in its entirety, and the priority of which is hereby claimed under 35 USC 119.

What is claimed is:

1. A ski for alpine skiing, said ski comprising:

a longitudinally central portion provided to receive boot retaining elements, two longitudinally spaced zones of increased thickness in said central portion caused by a progressive variation in thickness of the ski in said spaced zones, the ski having an upper surface in said spaced zones with a convex undulating shape, wherein the thickness of the ski progressively increases and then decreases, wherein said two longitudinally spaced zones of increased thickness of said central portion of the ski includes at least one upper reinforcement layer having a variable vertical position corresponding to said variation in thickness of the ski in said spaced zones, and wherein said zones of increased thickness are provided to receive a binding interface device mounted thereon for pivotal movement relative to the ski about longitudinally spaced transverse axes of the ski, for permitting flexing of the ski relative to said binding interface device.

2. A ski according to claim 1, wherein between the zones of increased thickness, the ski has an intermediate zone in which the thickness of the ski is substantially constant and equal to the thickness of the ski forward and rearward of the increased thickness zones.

3. A ski according to claim 1, wherein between the zones of increased thickness, the ski has an intermediate zone in which the thickness of the ski varies progressively along an undulation, where the thickness of the ski decreases progressively until it reaches a value that is less than the thickness upstream and downstream of the increased thickness zones, and then increases progressively.

4. A ski according to claim 1, wherein in an intermediate zone between said zones of increased thickness, the ski has a reinforcement formed of at least one reinforcement strip.

5. A ski according to claim 1, wherein forward and/or rearward of both of the increased thickness zones, the ski has a reinforcement formed by at least one reinforcement strip.

6. A ski according to claim 1, wherein said at least one upper reinforcement layer has a convex undulating shape corresponding to said two longitudinally spaced zones.

7. A gliding apparatus comprising:

a ski having a localized increase in thickness in two longitudinally spaced zones along at least a portion of a width of said ski, each of said zones of localized increased thickness including at least one reinforcement layer having a variable vertical position corresponding to said increase in thickness of the ski in said spaced zones; and a binding interface device connected to said ski, said binding interface device comprising a front plate having a mounting zone provided for a front retaining element, a rear plate with a mounting zone provided for a rear retaining element, each said plate being extended downwardly by lower wings along opposite side edges of said ski, said wings being connected to said ski by means of journal elements at said two longitudinally spaced zones, for permitting flexing of the ski relative to said binding interface device.

8. A gliding apparatus according to claim 7, wherein in each said zone of increased thickness, an upper surface of the ski, at least along a portion of the ski width, has a localized, substantially convex shape extending in the longitudinal direction of the ski, and corresponding to a progressive variation in thickness.

9. A gliding apparatus according to claim 7, wherein the ski has openings and each wing of the device has corresponding openings across from the openings of the ski, for one of said journal elements.

10. A gliding apparatus according to claim 7, wherein said at least one reinforcement layer comprises an upper reinforcement layer, and said journal elements are located in support beneath said upper reinforcement layer of the ski.

11. A gliding apparatus according to claim 7, wherein the ski openings have an insert provided to receive respective ones of said journal elements.

12. A gliding apparatus according to claim 7, wherein said front and rear plates are kept raised above an upper surface of the ski by two filtering pads located along the interface device at a height of said wings.

13. A ski according to claim 7, wherein said at least one upper reinforcement layer has a longitudinally extending convex shape corresponding to said zones of localized increased thickness.

14. An alpine ski comprising:

a plurality of structural components, said structural components comprising at least a core, a gliding sole beneath said core, an upper reinforcement layer above said core;

said plurality of structural components defining a longitudinally extending boot retention portion for supporting front and rear boot retaining elements, said boot retention portion having a varying thickness between an upper surface and a lower surface, including at least two longitudinally spaced apart zones, each of said spaced apart zones having an increased thickness relative to thickness of longitudinally adjacent zones;

said upper reinforcement layer being more greatly spaced from said gliding sole in said two longitudinally spaced apart zones than in said longitudinally adjacent zones;

wherein said zones of increased thickness are provided to receive a binding interface device mounted thereon for pivotal movement relative to the ski about longitudinally spaced transverse axes of the ski, for permitting flexing of the ski relative to said binding interface device.

15. An alpine ski according to claim 14, wherein:

an intermediate zone is positioned between said two longitudinally spaced apart zones of increased thickness, said intermediate zone having a substantially uniform thickness, said uniform thickness being substantially equal to a thickness of the ski immediately forward and rearward of said two longitudinally spaced apart zones of increased thickness.

16. An alpine ski according to claim 14, wherein:

an intermediate zone is positioned between said two longitudinally spaced apart zones of increased thickness, said intermediate zone having a thickness varying progressively along an undulation, the thickness of the ski decreasing progressively until the thickness reaches a values less than a thickness upstream and downstream of said longitudinally spaced apart zones of increased thickness, and then increases progressively.

17. An alpine ski according to claim 14, further comprising:

a reinforcement longitudinally extending between said two longitudinally spaced apart zones, said reinforcement comprising a reinforcement strip.

18. An alpine ski according to claim 14, further comprising:

forward and/or rearward of both of the increased thickness zones, the ski has a longitudinally extending reinforcement formed by at least one reinforcement strip.

19. An alpine ski according to claim 14, wherein:

a respective transverse opening is provided in each of said two longitudinally spaced apart zones, said openings being adapted to facilitate assembly of journal connections between a binding interface device and the ski, each of said transverse openings being positioned beneath said upper reinforcement layer.

20. A gliding apparatus comprising:

a ski having a localized increase in thickness in two longitudinally spaced zones along at least a portion of a width of said ski, each of said zones of localized increased thickness including at least one reinforcement layer; and a binding interface device connected to said ski, said binding interface device comprising a front plate having a mounting zone provided for a front retaining element, a rear plate with a mounting zone provided for a rear retaining element, each said plate being extended downwardly by lower wings along opposite side edges of said ski, said wings being connected to said ski by means of journal elements extending through said portion of said width of said ski at said two longitudinally spaced zones, for permitting flexing of the ski relative to said binding interface device.

21. A gliding apparatus according to claim 20, wherein:

said at least one upper reinforcement layer has a longitudinally extending convex shape corresponding to said zones of localized increased thickness.

22. A gliding apparatus according to claim 20, wherein:

said journal elements extend along transverse axes positioned beneath said reinforcement layer.

* * * * *